United States Patent [19]

Ericson

[11] 4,212,314

[45] Jul. 15, 1980

[54] WASTE WATER OUTLET SANITARY PLANT COMPRISING A SIPHON

[76] Inventor: Kurt S. B. Ericson, 17 Goudenregenlaan, B-2610 Wilrijk, Belgium

[21] Appl. No.: 938,332

[22] Filed: Aug. 31, 1978

[30] Foreign Application Priority Data

Aug. 31, 1977 [BE] Belgium ..... 858266

[51] Int. Cl.[2] ..... E03C 1/295

[52] U.S. Cl. ..... 137/216.2; 137/247.35; 137/247.43; 137/357; 137/362

[58] Field of Search ..... 137/216.2, 247.35, 247.41, 137/247.43, 247.45, 247.47, 247.49, 247.51, 357, 362; 4/207, 211

[56] References Cited

U.S. PATENT DOCUMENTS

| | | | |
|---|---|---|---|
| 202,250 | 4/1878 | Dunn et al. | 137/247.35 X |
| 209,975 | 11/1878 | Morey | 137/216.2 |
| 539,689 | 5/1895 | Knispel | 137/216.2 X |
| 605,202 | 6/1898 | Mullenhoff | 137/216.2 |
| 1,336,280 | 4/1920 | Carroll | 137/526 |
| 2,852,034 | 9/1958 | Shames et al. | 137/217 |
| 3,605,132 | 9/1971 | Lineback | 137/526 UX |

FOREIGN PATENT DOCUMENTS

| | | | |
|---|---|---|---|
| 856064 | 12/1960 | United Kingdom | 137/216.2 |
| 1220982 | 1/1971 | United Kingdom | 137/216.2 |
| 1397705 | 6/1975 | United Kingdom | 137/216.2 |

*Primary Examiner*—Gerald A. Michalsky
*Attorney, Agent, or Firm*—McGlew and Tuttle

[57] ABSTRACT

The present invention relates to a waste water outlet sanitary plant comprising a siphon forming a water seal to which is connected a waste pipe for connection with sewers and in which an automatic air valve device and a siphon are combined in one single apparatus so that their functions are complementary. A cylindrical body having a permanent water seal and in which a pipe or equivalent connected to an apparatus such as a sink, a basin, or waste outlet is dipping, is combined with an automatic air valve with peripheral air entry. An embodiment of the invention relates to a plant for dwellings in which a series of water outlets are provided at the height of different floors or sub-basements.

4 Claims, 5 Drawing Figures

FIG. 1
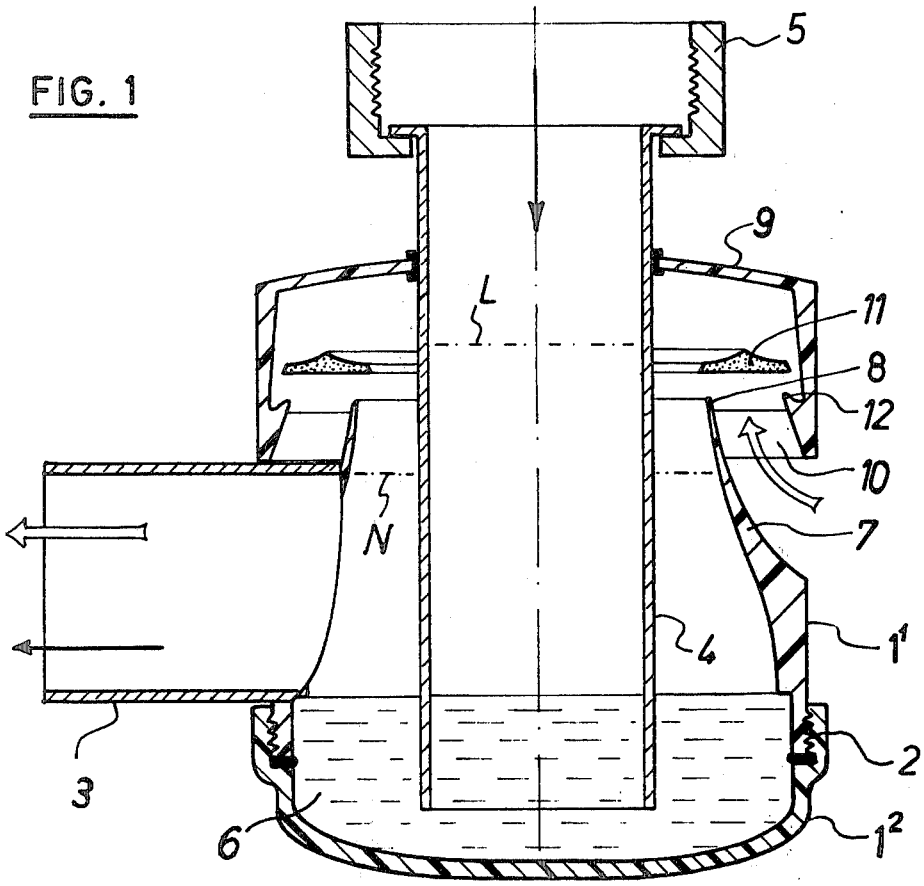
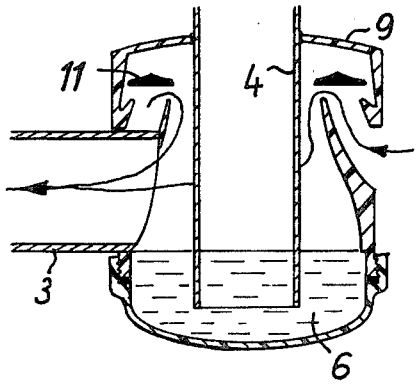
FIG. 1A
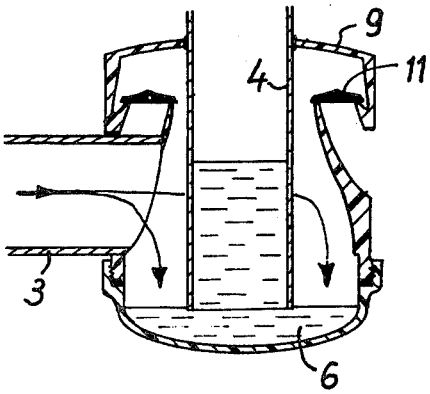
FIG. 1B

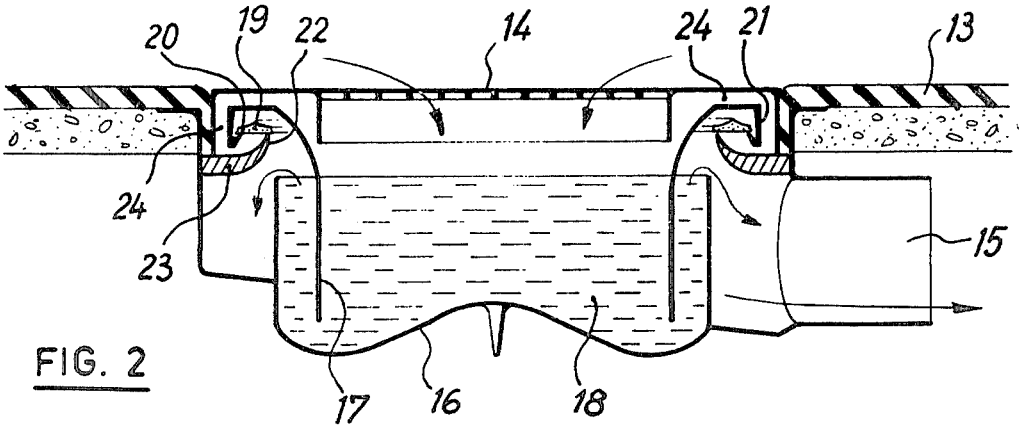
FIG. 2
FIG. 3
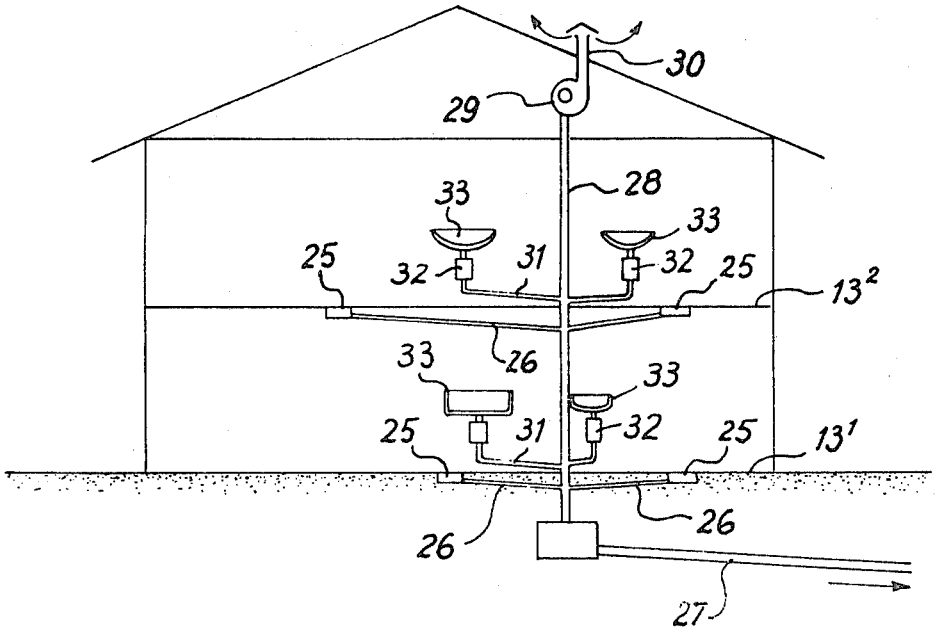

WASTE WATER OUTLET SANITARY PLANT COMPRISING A SIPHON

FIELD AND BACKGROUND OF THE INVENTION

This invention relates in general to the waste water outlet of sanitary plants comprising a siphon forming a water seal to which is connected a waste pipe for connection with sewers. As it is well known that a permanent water seal in the form of siphons used in sanitary equipment is one of the basic requirements for the normal operation of a waste water outlet plant.

In a waste outlet system, siphons undergo several influences the consequences of which may be flowing of water from the apparatus itself by negative pressure in the connecting line or sucking caused by flowing water coming from other devices.

SUMMARY OF THE INVENTION

The invention has for one of its principal objects to avoid loss of water in the siphons and also to obtain improved hydraulic conditions.

With this object in view, the plant according to the present invention is essentially characterised by the fact that with a cylindrical container in which there extends a pipe or other equivalent element connected to an apparatus such as a sink, a basin, etc. or waste outlet with formation of a water seal into the container, there is combined an automatic valve system for a peripheral air inlet, the whole acting so as to fulfil several functions which will be enumerated hereafter.

For an understanding of the principles of the invention, reference is made to the following description of typical embodiments thereof as illustrated in the accompanying drawings.

In the Drawings

FIG. 1 is a side sectional view of a hydraulic installation according to one embodiment of the invention;

FIG. 1*a* is a view similar to FIG. 1 showing a flow of air into the device;

FIG. 1*b* is a view similar to FIG. 1 showing the invention when an overpressure of air exists in the device;

FIG. 2 is a side sectional view of another embodiment of the present invention; and FIG. 3 is a schematic side elevational view of a dwelling equipped with the inventive hydraulic installation at various locations thereof.

DESCRIPTION OF THE PREFERRED EMBODIMENTS

In FIG. 1, there is represented a hydraulic device for the drainage of waste water having a siphon formed of a cylindrical body or container having two parts $1^1$ and $1^2$ connected with one another by a threaded coupling at 2 and to which is connected to an outlet pipe 3 which is connected to the sewers;

In to cylindrical body $1^1$, $1^2$ which contains a water seal 6, an inlet pipe 4 is extends and is connected to a waste outlet apparatus 5 (sink, basin, etc.). The lower end of pipe 4 extends into water seal 6.

At its upper end the valve body has a constriction defining automatic air valve means in the form of a Venturi made of a frustoconical neck 7 ending with a lip 8 for cooperating with a cover 9 to form an air inlet through a peripheral entry or inlet duct 10 which can be shut off by an annular valve 11. The latter is located at the exterior of the frustoconical neck and rests on a seat formed by the lip 8 and by a lip 12 provided on the inner periphery of the cover.

A device of that kind is described and protected as such in a separate patent application filed simultaneously by the inventor with the present patent application having Ser. No. 938,337.

When a negative pressure occurs in the waste outlet pipe 3, for example as a result of a draining, the valve 11 is lifted so that fresh air can penetrate into the pipe 3 via the duct 10 (FIG. 1A). When the pressure is equilibrated or when there is an overpressure, the duct 10 is shut-off by the valve 11 so that contaminated air is prevented from escaping.

There is thus provided an apparatus in which the automatic valve device 11 and a siphon are combined in one single apparatus so that their functions are complementary to one another.

In such an assembly, when a negative pressure occurs, sucking of the water seal 6 formed by the siphon is prevented.

The water can never rise above the level N corresponding to the upper part of the outlet 3, for example upon jamming, by reason of the presence of an air cushion in the cover 9 and this is so even if the level is higher in the pipe 4 (level L).

On the other hand, an important point is that the flow of water and the flow of air are separate and independent in such a manner the water can flow through the whole cross section of the pipes 3 and that in view of the absence of an air core so that, the sizes of the pipes in relation with the sewers may be reduced and the hydraulic conditions and yield are improved.

Such an assembly therefore fulfil simultaneously a plurality of functions:

(1) maintenance of the water seal;

(2) water flow throughout the whole cross-section of the duct and flow of the air in an intermittent way;

(3) contaminated air is prevented from escaping in inhabited places.

The height of the water seal 6 which normally is about 50 mm can be reduced since the valve 11 takes over the negative pressure (FIG. 1A). However care is to be taken that the level remains such that it permits the creation of a water column in the tube 4 sufficient in case of overpressure (FIG. 1B).

Thus the height of the whole plant may be reduced.

FIG. 2 represents the application of the invention to an outlet or grid for discharging waste water.

On FIG. 2 there is represented at 13 a floor, a sub-basement or an arch having a hole which receives a grid 14 being part of a waste water outlet via a pipe 15.

This device comprises a vessel or container 16 into which a removable basket 17 extends and which receives the waste water entering through the grid 14 while forming therein a hydraulic seal or closure 18.

In accordance with the invention, there is provided above the container or vessel 16 a valve 19 in the form of a ring cooperating with a seat made of:

(a) a lip 20 formed by a fold 21 at the top part of the basket 17;

(b) a lip 22 formed by a part 23 fixed beneath the sub-basement or arch 13.

Under these circumstances, when a negative pressure occurs in the waste outlet pipe 15 for example upon draining, the valve 19 is lifted so that fresh air can penetrate into the pipe 15 through the grid 14 and the gap 24 between the basket 17 and the periphery of the hole formed by the sub-basement 13.

When the pressure is equilibrated or when there is overpressure, the valve 19 is in shut-off position so that contamined air is prevented from escaping.

The correct operation of the valve 19 can not be prevented because, if the water rises in the vessel 16, there is always an air cushion around the valve 19 so that the valve cannot be forced back by the water.

An important advantage is that the vessel 16 containing the water seal can be constructed with a very low height (for example less than 100 mm) which is very important since arches and sub-basements may be made in a more economical way.

FIG. 3 shows a plant for habitations in which a series of waste outlets 25 of the kind illustrated in FIG. 2 are provided at the height of different floors or sub-basements $13^1$, $13^2$, etc.

A pipe 26 is connected to each of these devices 25 for connection with the waste water pipe 27.

The pipes 26 are connected with the pipe 27 through a vent pipe 28 provided with a fan 29 having an outlet 30 for delivering the waste air to the exterior.

With the pipe 28 there may be connected pipes 31 which in their turn are connected with siphons 32 of the kind illustrated in FIG. 1 and with devices 33 such as sinks, etc.

It will be understood that the fan 29 when in operation may act to create a negative pressure in all of the pipes 26–31 and lift the different valves which correspond to each outlet 25 or apparatus 33. A waste air outlet can thus occur, through the pipe 28 at 30, while keeping the water seal 6 or 18 in all of the devices without it being sucked away.

In that way the whole building may be ventilated through the waste water pipes and waste air outlet pipes are no longer needed.

What I claim is:

1. A hydraulic device for the drainage of waste water from a spilling unit into a sewer comprising a container adapted for receiving a water seal therein, an inlet pipe extending from the spilling unit into said container having a lower end adapted to extend into the water seal contained in said container, an outlet pipe extending from said container and adapted to be connected to a sewer, automatic air valve means connected to said container for permitting the inlet of air into said container and blocking the outflow of air from said container, said automatic air valve means comprising an upper part of said container defining a frusto-conical neck diminishing in diameter upwardly of said container, a cover extending over said container and defining with said frusto-conical neck of said container a peripheral air inlet, and an annular valve resting over said peripheral air inlet, said annular valve adapted to be lifted by air entering said chamber when a negative pressure occurs in said outlet pipe so as to permit the introduction of sufficient quantity of fresh air and for resting over said peripheral air inlet to block the passage of air out of said container when air pressure in said outlet pipe is balanced with respect to pressure exterior to said container and when there is an overpressure in said outlet pipe whereby waste water can flow through an entire cross-sectional area of said outlet pipe into the sewer, whereas the air flow takes place after the waste water stops streaming from the spilling unit.

2. A device according to claim 1, wherein said cover defines a closed air cushion space above said annular valve whereby the water seal in said container cannot rise to the level of said peripheral air inlet.

3. A device according to claim 1, wherein said container is cylindrical and said inlet pipe extends through said cover.

4. A device according to claim 1, wherein said peripheral air inlet is in the shape of a Venturi for the inflow of air into said container.

* * * * *